US008714272B2

(12) United States Patent
Garcia et al.

(10) Patent No.: US 8,714,272 B2
(45) **Date of Patent: *May 6, 2014**

(54) CLUSTER OPENING SLEEVES FOR WELLBORE

(75) Inventors: Cesar G. Garcia, Katy, TX (US); Patrick J. Zimmerman, Houston, TX (US); David Ward, Houston, TX (US); Antonio B. Flores, Houston, TX (US); Michael Dedman, Powell, WY (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/587,470

(22) Filed: Aug. 16, 2012

(65) Prior Publication Data

US 2012/0305265 A1 Dec. 6, 2012

Related U.S. Application Data

(63) Continuation of application No. 13/087,635, filed on Apr. 15, 2011, now Pat. No. 8,245,788, which is a continuation-in-part of application No. 12/613,633, filed on Nov. 6, 2009, now Pat. No. 8,215,411.

(51) Int. Cl.

| | |
|---|---|
| ***E21B 33/12*** | (2006.01) |
| ***E21B 23/04*** | (2006.01) |
| ***E21B 34/14*** | (2006.01) |
| ***E21B 43/26*** | (2006.01) |

(52) U.S. Cl.

CPC ..... *E21B 34/14* (2013.01); *E21B 43/26* (2013.01)

USPC ..... 166/386; 166/194; 166/317; 166/318

(58) Field of Classification Search

CPC ..... E21B 34/14; E21B 43/26

USPC ..... 166/386, 194, 297, 308.1, 376, 317, 166/318

See application file for complete search history.

(56) References Cited

U.S. PATENT DOCUMENTS

| | | | | |
|---|---|---|---|---|
| 3,434,537 | A | 3/1969 | Zandmer | |
| 4,520,870 | A * | 6/1985 | Pringle | 166/317 |
| 4,823,882 | A | 4/1989 | Stokley et al. | |
| 4,893,678 | A | 1/1990 | Stokley et al. | |
| 4,949,788 | A | 8/1990 | Szarka et al. | |
| 5,022,424 | A | 6/1991 | Reynolds et al. | |
| 5,146,992 | A | 9/1992 | Baugh | |
| 5,224,556 | A | 7/1993 | Wilson et al. | |

(Continued)

OTHER PUBLICATIONS

Halliburton brochure; Completion Tools, "Delta Stim Sleeve: Designed for Selective Multi-Zone Fracturing or Acidizing Through the Completion," H04616, Sep. 2008.

(Continued)

*Primary Examiner* — Cathleen Hutchins

(74) *Attorney, Agent, or Firm* — Wong, Cabello, Lutsch, Rutherford & Brucculeri LLP

(57) ABSTRACT

A downhole sleeve has an insert movable in the sleeve's bore from a closed condition to an opened condition when a ball dropped in the bore engages an indexing seat in the sliding sleeve. In the closed condition, the insert prevents communication between the bore and the sleeve's port, while the insert in the opened condition permits communication between the bore and port. Keys of a seat extend into the bore to engage the ball and to move the insert open. After opening, the keys retract so the ball can pass through the sleeve to another cluster sleeve or to an isolation sleeve of an assembly. Insets or buttons disposed in the sleeve's port temporarily maintain fluid pressure in the sleeve's bore so that a cluster of sleeves can be opened before treatment fluid dislodges the button to treat the surrounding formation through the open port.

40 Claims, 7 Drawing Sheets

(56) References Cited

U.S. PATENT DOCUMENTS

| | | | |
|---|---|---|---|
| 5,244,044 | A | 9/1993 | Henderson |
| 5,425,424 | A | 6/1995 | Reinhardt et al. |
| 5,631,634 | A | 5/1997 | Strelow |
| 5,960,884 | A | 10/1999 | Echols |
| 6,041,857 | A | 3/2000 | Carmody et al. |
| 6,155,350 | A | 12/2000 | Melenyzer |
| 6,349,766 | B1 | 2/2002 | Bussear et al. |
| 6,464,008 | B1 | 10/2002 | Roddy et al. |
| 6,634,428 | B2 | 10/2003 | Krauss et al. |
| 6,907,936 | B2 | 6/2005 | Fehr et al. |
| 6,920,930 | B2 | 7/2005 | Allamon et al. |
| 7,108,067 | B2 | 9/2006 | Themig et al. |
| 7,347,289 | B2 | 3/2008 | Lee |
| 7,387,165 | B2 | 6/2008 | Lopez de Cardenas et al. |
| 7,617,871 | B2 | 11/2009 | Surjaatmadja et al. |
| 2002/0100596 | A1 | 8/2002 | Nguyen et al. |
| 2003/0127227 | A1 | 7/2003 | Fehr et al. |
| 2004/0118564 | A1 | 6/2004 | Themig et al. |
| 2006/0124310 | A1* | 6/2006 | Lopez de Cardenas et al. ..... 166/313 |
| 2007/0272411 | A1 | 11/2007 | Lopez De Cardenas et al. |
| 2008/0093080 | A1 | 4/2008 | Palmer et al. |
| 2009/0084553 | A1 | 4/2009 | Rytlewski et al. |

OTHER PUBLICATIONS

Halliburton brochure; Service Tools, "Delta Stim Lite Sleeve: Designed for Selective Multi-Zone Fracturing or Acidizing Through the Completion," H06033, Jul. 2009.

DSI Brochure; "PBL-Multiple Activation Autolock Bypass Systems," obtained from http://www.dsi-pbl.com, undated.

DSI, "Autolock Bypass System," obtained from http://www.dsi-pbl.com/, generated on Oct. 28, 2009.

DSI, "Autolock Bypass System—application," obtained from http://www.dsi-pbl.com/, generated on Oct. 28, 2009.

DSI Brochure, "PBL Multiple Activation Autolock Bypass System," obtained from http://www.dsi-pbl.com/, undated.

Weatherford Brochure, "WXO and WXA Standard Sliding Sleeves," 4603.02, copyrighted 2007-2008.

First Office Action in copending U.S. Appl. No. 12/613,633, mailed Sep. 27, 2011.

Reply to First Office Action in copending U.S. Appl. No. 12/613,633, filed Dec. 27, 2011.

Notice of Allowance in copending U.S. Appl. No. 12/613,633, mailed Feb. 29, 2012.

Notice of Protest in counterpart Canadian Appl. No. 2,716,834, mailed Mar. 20, 2012.

First Requisition in counterpart Canadian Appl. No. 2,716,834, mailed Mar. 28, 2012.

Examination Requisition in counterpart Canadian Appl. 2,772,277, dated Oct. 1, 2013.

Examination Report in counterpart Australian Appl. 2012201482, dated Aug. 20, 2013.

Search Report in counterpart EP Appl. EP 12 16 4003, dated Aug. 1, 2013.

* cited by examiner

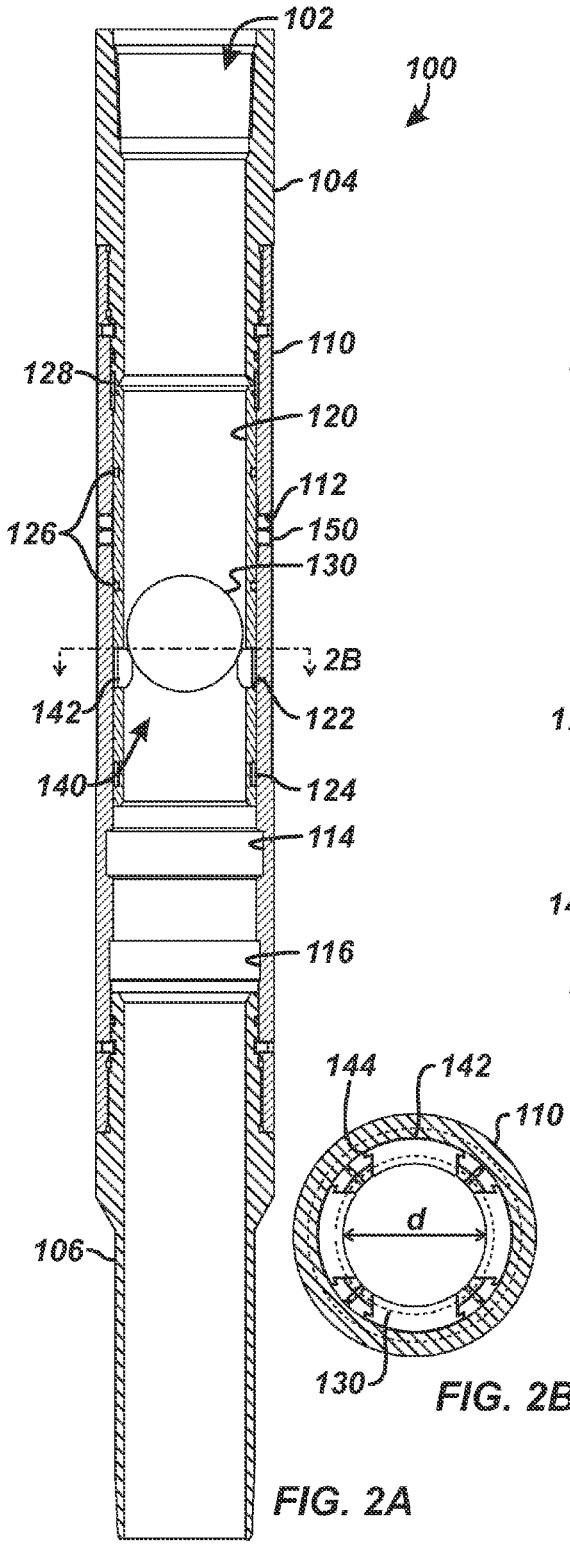
FIG. 2A
FIG. 2B
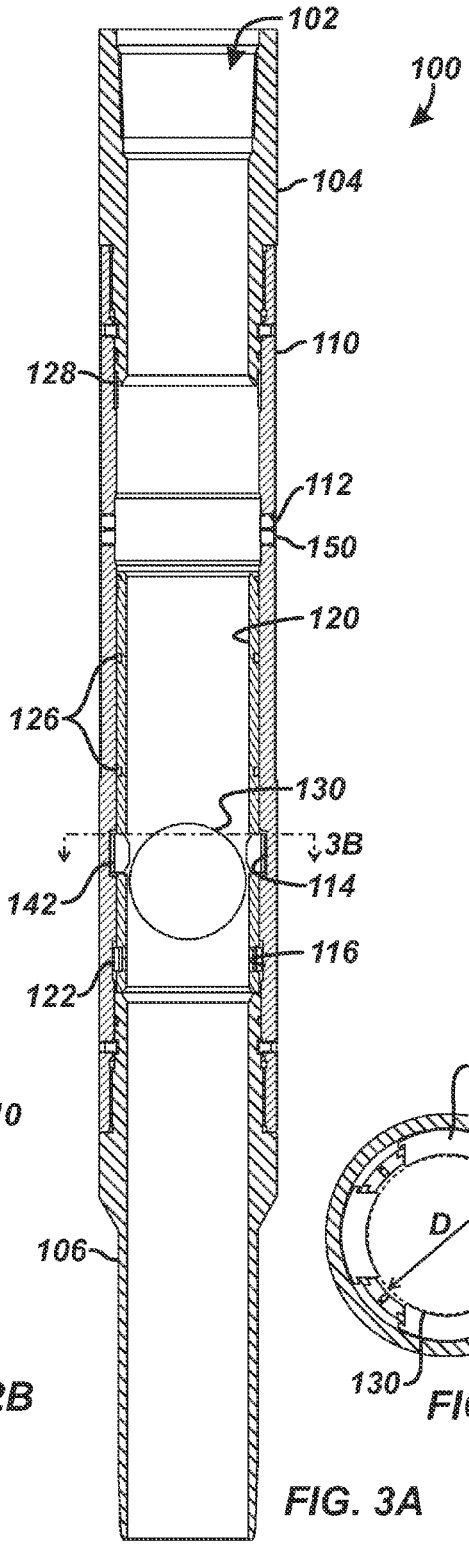
FIG. 3A
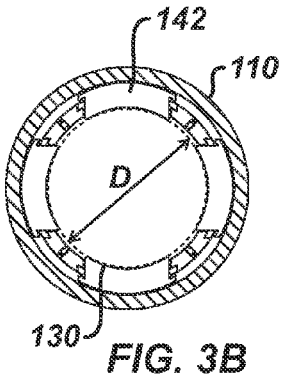
FIG. 3B

CLUSTER OPENING SLEEVES FOR WELLBORE

CROSS-REFERENCE TO RELATED APPLICATIONS

This is a continuation of U.S. patent application Ser. No. 13/087,635, filed 15 Apr. 2011, which is a continuation-in-part of U.S. patent application Ser. No. 12/613,633, filed 6 Nov. 2009, which are both incorporated herein by reference in its entirety and to which priority is claimed.

BACKGROUND

In a staged frac operation, multiple zones of a formation need to be isolated sequentially for treatment. To achieve this, operators install a frac assembly down the wellbore. Typically, the assembly has a top liner packer, open hole packers isolating the wellbore into zones, various sliding sleeves, and a wellbore isolation valve. When the zones do not need to be closed after opening, operators may use single shot sliding sleeves for the frac treatment. These types of sleeves are usually ball-actuated and lock open once actuated. Another type of sleeve is also ball-actuated, but can be shifted closed after opening.

Initially, operators run the frac assembly in the wellbore with all of the sliding sleeves closed and with the wellbore isolation valve open. Operators then deploy a setting ball to close the wellbore isolation valve. This seals off the tubing string so the packers can be hydraulically set. At this point, operators rig up fracturing surface equipment and pump fluid down the wellbore to open a pressure actuated sleeve so a first zone can be treated.

As the operation continues, operates drop successively larger balls down the tubing string and pump fluid to treat the separate zones in stages. When a dropped ball meets its matching seat in a sliding sleeve, the pumped fluid forced against the seated ball shifts the sleeve open. In turn, the seated ball diverts the pumped fluid into the adjacent zone and prevents the fluid from passing to lower zones. By dropping successively increasing sized balls to actuate corresponding sleeves, operators can accurately treat each zone up the wellbore.

Because the zones are treated in stages, the lowermost sliding sleeve has a ball seat for the smallest sized ball size, and successively higher sleeves have larger seats for larger balls. In this way, a specific sized dropped ball will pass though the seats of upper sleeves and only locate and seal at a desired seat in the tubing string. Despite the effectiveness of such an assembly, practical limitations restrict the number of balls that can be run in a single tubing string. Moreover, depending on the formation and the zones to be treated, operators may need a more versatile assembly that can suit their immediate needs.

The subject matter of the present disclosure is directed to overcoming, or at least reducing the effects of, one or more of the problems set forth above.

SUMMARY

A cluster of sliding sleeve deploys on a tubing sting in a wellbore. Each sliding sleeve has an inner sleeve or insert movable from a closed condition to an opened condition. When the insert is in the closed condition, the insert prevents communication between a bore and a port in the sleeve's housing. To open the sliding sleeve, a plug (ball, dart, or the like) is dropped into the sliding sleeve. When reaching the sleeve, the ball engages a corresponding seat in the insert to actuate the sleeve from the closed condition to the opened condition. Keys or dogs of the insert's seat extend into the bore and engage the dropped ball, allowing the insert to be moved open with applied fluid pressure. After opening, fluid can communicates between the bore and the port.

When the insert reaches the opened condition, the keys retract from the bore and allow the ball to pass through the seat to another sliding sleeve deployed in the wellbore. This other sliding sleeve can be a cluster sleeve that opens with the same ball and allows the ball to pass therethrough after opening. Eventually, however, the ball can reach an isolation sleeve deployed on the tubing string that opens when the ball engages its seat but does not allow the ball to pass therethrough. Operators can deploy various arrangements of cluster and isolation sleeves for different sized balls to treat desired isolated zones of a formation.

Insets or buttons disposed in the sleeve's port temporarily maintain fluid pressure in the sleeve's bore so that a cluster of sleeves can be opened before treatment fluid dislodges the button to treat the surrounding formation through the open port. The button can have a small orifices therethrough that allows a pressure differential to develop that may help the insert move from the closed to the opened condition. The button can be dislodged by high-pressure, breaking, erosion, or a combination of these. For example, the button may be forced out of the port when the high-pressure treatment fluid is pumped into the sleeve. Additionally, one or more orifices and slots on the button can help erode the button in the port to allow treatment fluid to exit. In dislodging the button in this manner, the erosion can wear away the button and may help break up the button to force it out of the port.

The foregoing summary is not intended to summarize each potential embodiment or every aspect of the present disclosure.

BRIEF DESCRIPTION OF THE DRAWINGS

FIG. 2A illustrates an axial cross-section of a cluster sliding sleeve according to the present disclosure in a closed condition.

FIG. 2B illustrates a lateral cross-section of the cluster sliding sleeve in FIG. 2A.

FIG. 3A illustrates another axial cross-section of the cluster sliding sleeve in an open condition.

FIG. 3B illustrates a lateral cross-section of the cluster sliding sleeve in FIG. 3A.

DETAILED DESCRIPTION

Figure 1:
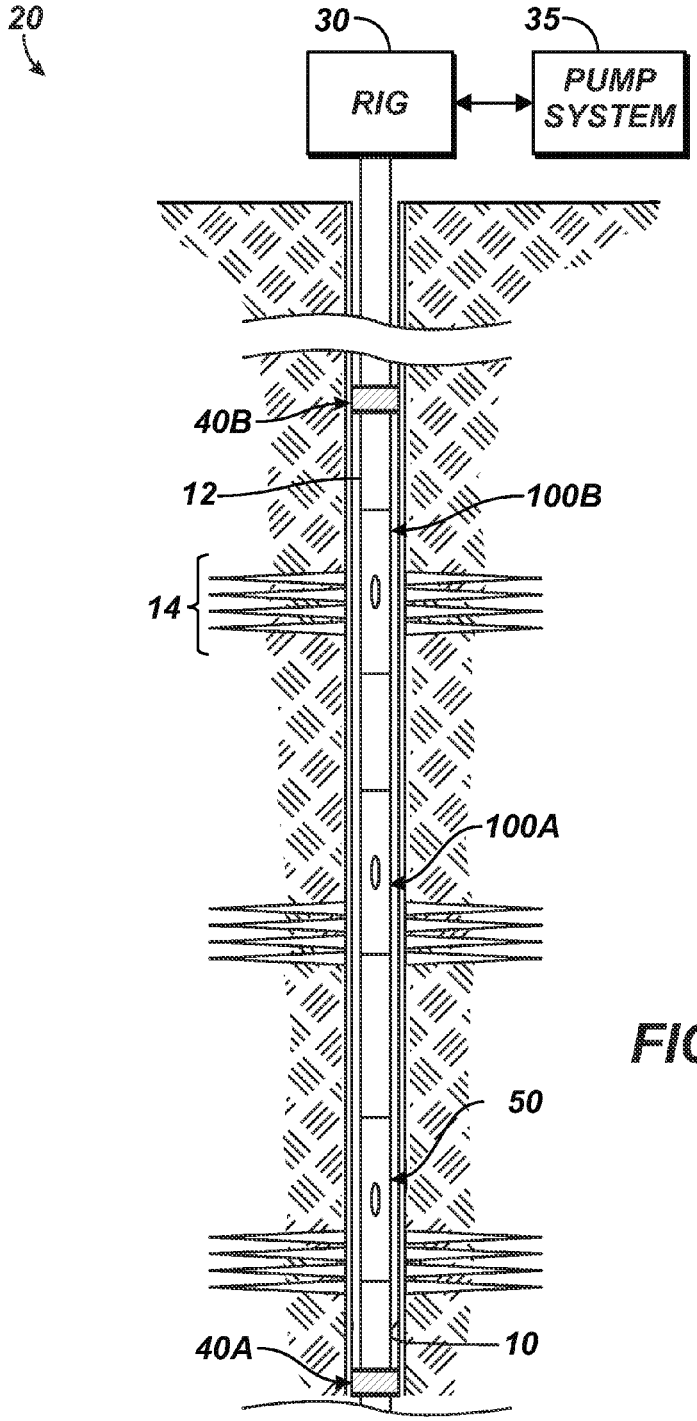
FIG. 1 diagrammatically illustrates a tubing string having multiple sleeves according to the present disclosure.

A tubing string 12 shown in FIG. 1 deploys in a wellbore 10. The string 12 has an isolation sliding sleeve 50 and cluster sliding sleeves 100A-B disposed along its length. A pair of packers 40A-B isolate portion of the wellbore 10 into an isolated zone. In general, the wellbore 10 can be an opened or cased hole, and the packers 40A-B can be any suitable type of packer intended to isolate portions of the wellbore into isolated zones. The sliding sleeves 50 and 100A-B deploy on the tubing string 12 between the packers 40A-B and can be used to divert treatment fluid to the isolated zone of the surrounding formation.

The tubing string 12 can be part of a frac assembly, for example, having a top liner packer (not shown), a wellbore isolation valve (not shown), and other packers and sleeves (not shown) in addition to those shown. The wellbore 10 can have casing perforations 14 at various points. As conventionally done, operators deploy a setting ball to close the wellbore isolation valve, rig up fracturing surface equipment, pump fluid down the wellbore, and open a pressure actuated sleeve so a first zone can be treated. Then, in a later stage of the operation, operators actuate the sliding sleeves 50 and 100A-B between the packers 40A-B to treat the isolated zone depicted in FIG. 1.

Briefly, the isolation sleeve 50 has a seat (not shown). When operators drop a specifically sized plug (e.g., ball, dart, or the like) down the tubing string 12, the plug engages the isolation sleeve's seat. (For purposes of the present disclosure, the plug is described as a ball, although the plug can be any other acceptable device.) As fluid is pumped by a pump system 35 down the tubing string 12, the seated ball opens the isolation sleeve 50 so the pumped fluid can be diverted out ports to the surrounding wellbore 10 between packers 40A-B.

In contrast to the isolation sleeve 50, the cluster sleeves 100A-B have corresponding seats (not shown) according to the present disclosure. When the specifically sized ball is dropped down the tubing string 12 to engage the isolation sleeve 50, the dropped ball passes through the cluster sleeves 100A-B, but opens these sleeves 100A-B without permanently seating therein. In this way, one sized ball can be dropped down the tubing string 12 to open a cluster of sliding sleeves 50 and 100A-B to treat an isolated zone at particular points (such as adjacent certain perforations 14).

Figure 6:
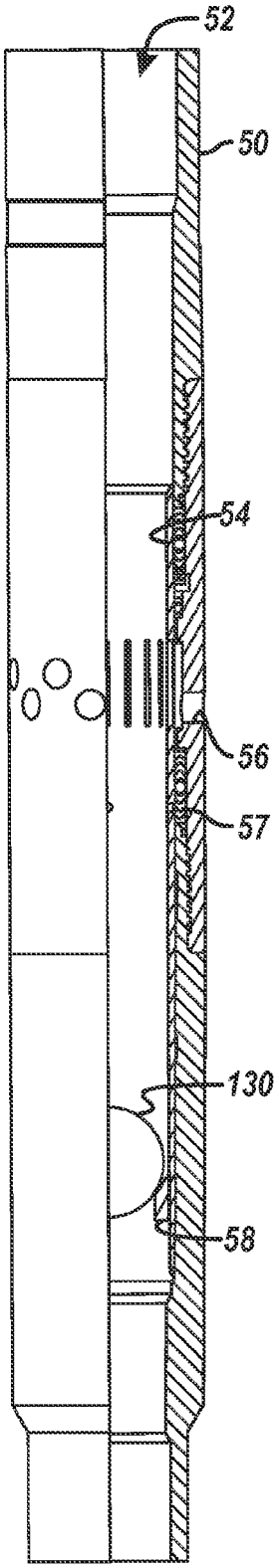
FIG. 6 illustrates an axial cross-section of an isolation sliding sleeve according to the present disclosure in an opened condition.

With a general understanding of how the sliding sleeves 50 and 100 are used, attention now turns to details of a cluster sleeve 100 shown in FIGS. 2A-2B and FIGS. 3A-3B and an isolation sleeve 50 shown in FIG. 6.

Turning first to FIGS. 2A through 3B, the cluster sleeve 100 has a housing 110 defining a bore 102 therethrough and having ends 104/106 for coupling to a tubing string. Inside the housing 110, an inner sleeve or insert 120 can move from a closed condition (FIG. 2A) to an open condition (FIG. 3A) when an appropriately sized ball 130 (or other form of plug) is passed through the sliding sleeve 100.

In the closed condition (FIG. 2A), the insert 120 covers external ports 112 in the housing 110, and peripheral seals 126 on the insert 120 keep fluid in the bore 102 from passing through these ports 112. In the open condition (FIG. 3A), the insert 120 is moved away from the external ports 112 so that fluid in the bore 102 can pass out through the ports 112 to the surrounding annulus and treat the adjacent formation.

To move the insert 120, the ball 130 dropped down the tubing string from the surface engages a seat 140 inside the insert 120. The seat 140 includes a plurality of keys or dogs 142 disposed in slots 122 defined in the insert 120. When the sleeve 120 is in the closed condition (FIG. 2A), the keys 142 extend out into the internal bore 102 of the cluster sleeve 100. As best shown in the cross-section of FIG. 2B, the inside wall of the housing 110 pushes these keys 142 into the bore 102 so that the keys 142 define a restricted opening with a diameter (d) smaller than the intended diameter (D) of the dropped ball. As shown, four such keys 142 can be used, although the seat 140 can have any suitable number of keys 142. As also shown, the proximate ends 144 of the keys 142 can have shoulders to catch inside the sleeve's slots 122 to prevent the keys 142 from passing out of the slots 122.

When the dropped ball 130 reaches the seat 140 in the closed condition, fluid pressure pumped down through the sleeve's bore 102 forces against the obstructing ball 130. Eventually, the force releases the insert 120 from a catch 128 that initially holds it in its closed condition. As shown, the catch 128 can be a shear ring, although a collet arrangement or other device known in the art could be used to hold the insert 120 temporarily in its closed condition.

Continued fluid pressure then moves the freed insert 120 toward the open condition (FIG. 3A). Upon reaching the lower extremity, a lock 124 disposed around the insert 120 locks the insert 120 in place. For example, the lock 124 can be a snap ring that reaches a circumferential slot 116 in the housing 110 and expands outward to lock the insert 120 in place. Although the lock 124 is shown as a snap ring 124 is shown, the insert 120 can use a shear ring or other device known in the art to lock the insert 120 in place.

When the insert 120 reaches its opened condition, the keys 124 eventually reach another circumferential slot 114 in the housing 110. As best shown in FIG. 3B, the keys 124 retract slightly in the insert 120 when they reach the slot 114. This allows the ball 130 to move or be pushed past the keys 124 so the ball 130 can travel out of the cluster sleeve 100 and further downhole (to another cluster sleeve or an isolation sleeve).

When the insert 120 is moved from the closed to the opened condition, the seals 126 on the insert 120 are moved past the external ports 112. A reverse arrangement could also be used in which the seals 126 are disposed on the inside of the housing 110 and engage the outside of the insert 120. As shown, the ports 112 preferably have insets or buttons 150 with small orifices that produce a pressure differential that helps when moving the insert 120. Once the insert 120 is moved, however, these insets 150, which can be made of aluminum or the like, are forced out of the port 112 when fluid pressure is applied during a frac operation or the like. Therefore, the ports 112 eventually become exposed to the bore 102 so fluid passing through the bore 102 can communicate through the exposed ports 112 to the surrounding annulus outside the cluster sleeve 100.

Figure 4A:
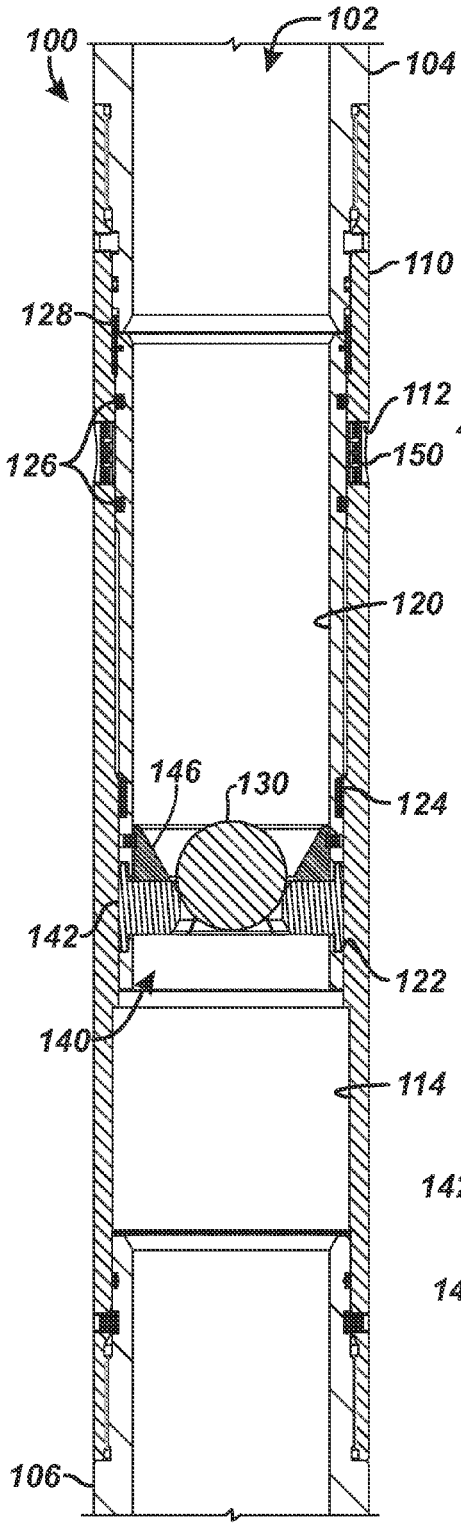
FIG. 4A illustrates an axial cross-section of another cluster sliding sleeve according to the present disclosure in a closed condition.
Figure 4B:
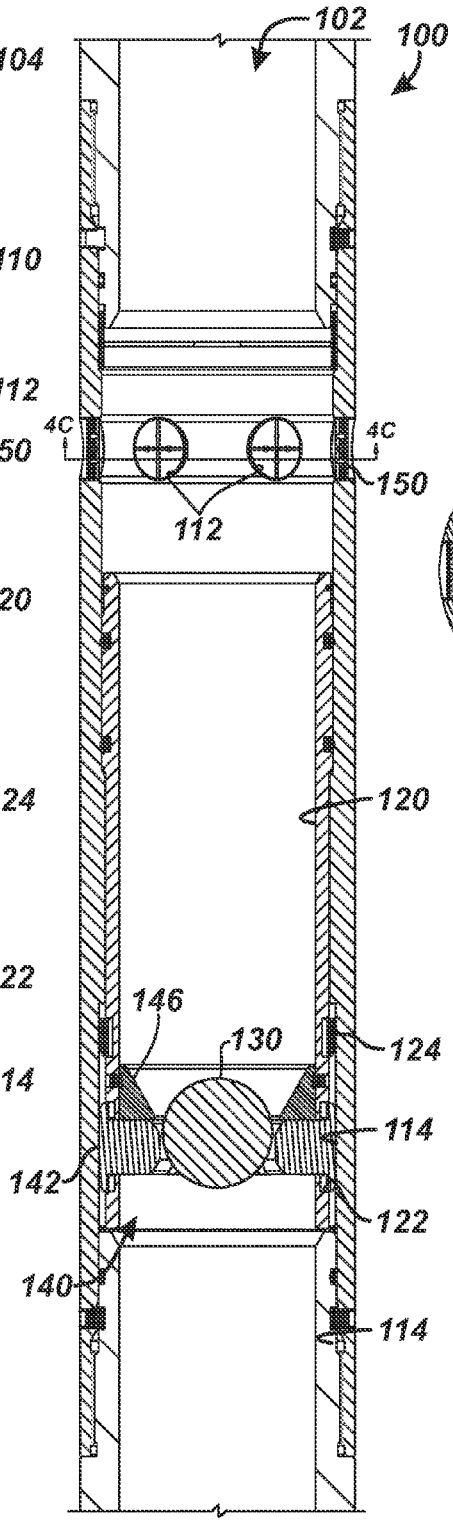
FIG. 4B illustrates an axial cross-section of the cluster sliding sleeve of FIG. 4A in an open condition.
Figure 4C:
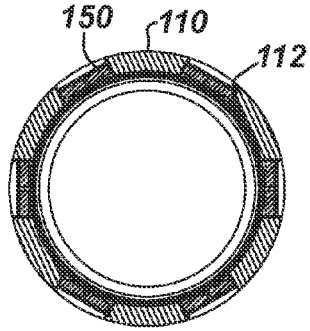
FIG. 4C illustrates a lateral cross-section of the cluster sliding sleeve in FIG. 4B.

Another embodiment of a cluster sliding sleeve 100 illustrated in FIGS. 4A-4C has many of the same features as the previous embodiment so that like reference numerals are used for the same components. As one difference, the cluster sleeve 100 has an orienting seat 146 fixed to the insert 120 just above the keys 142. The seat 146 helps guide a dropped ball 130 or other plug to the center of the keys 142 during operations and can help in creating at least a temporary seal at the seat 140 with the engaged ball 130.

As another difference, the cluster sleeve 100 has the lock 124, which can be a snap ring, disposed above the seat 140 as opposed to being below the seat 140 as in previous arrangements. The lock 124 engages in the circumferential slot 114 in the housing 110 used for the keys 142, and the lock 124 expands outward to lock the insert 120 in place. Therefore, an additional slot in the housing 110 may not be necessary.

Similar to other arrangements, this cluster sleeve 100 also has a plurality of insets or buttons 150 disposed in ports 112 of the housing 110. As before, these buttons 150 having one or more orifices and create a pressure differential to help open the insert 120. Additionally, the buttons 150 help to limit flow out of the sleeve 100 at least temporarily during use. To allow treatment fluid to eventually flow through the ports 112, the buttons 150 have a different configuration than previously described and are more prone to eroding as discussed below.

As disclosed previously, the cluster sleeve 100 can be used in a cluster system having multiple cluster sleeves 100, and each of the cluster sleeves 100 for a designated cluster can be opened with a single dropped ball 130. As the ball 130 reaches and seats in the upper-most sleeve 100 of the cluster, for example, tubing pressure applied to the temporarily seated ball 130 opens this first sleeve's insert 120. With the insert 120 in the closed condition of FIG. 4A, the insert's seals 126 prevent fluid flow through the buttons 150. However, the small orifices in the buttons 150 produce a pressure differential across the insert 120 that can help when moving the insert 120 open.

When the insert 120 moves down, the seat 140 disengages and frees the ball 130. Continuing downhole, the ball 130 then drops to the next lowest sleeve 100 in the cluster so the process can be repeated. Once the ball 130 seats at the lower-most sleeve of the cluster (e.g., an isolation sleeve), the frac operation can begin.

As the ball 130 drops and opens the various sleeves 100 of the cluster before reaching the lower-most sleeve, however, a sufficient tubing pressure differential must be maintained at least until all of the sleeves 100 in the cluster have been opened. Otherwise, lower sleeves 100 in the cluster may not open as tubing pressure escapes through the sleeve's ports 112 to the annulus. Therefore, it is necessary to obstruct the ports 112 temporarily in each sleeve 100 with the buttons 150 until the final sleeve of the cluster has been opened with the seated ball 130.

For this reason, the sleeve 100 uses the buttons 150 to temporarily obstruct the ports 112 and maintain a sufficient tubing pressure differential so all of the sleeves in the cluster can be opened. Once the insert 120 is moved to an open condition as in FIG. 4B, these buttons 150 are exposed to fluid flow. At this point, the fluid used to open the sleeves 100 in the cluster may only be allowed to escape slightly through the orifices in the buttons 150. This may be especially true when the pumped fluid used to open the sleeves is different from the treatment fluid used for the frac operation. Yet, the buttons 150 can be designed to limit fluid flow whether the pumped fluid is treatment fluid or some other fluid.

Once the buttons 150 are exposed to erosive flow (i.e., the treatment operation begins), the buttons 150 can start to erode as the treatment fluid in the sleeve 100 escapes through the button's orifices. Preferably, the buttons 150 are composed of a material with a low resistance to erosive flow. For example, the buttons 150 can use materials, such as brass, aluminum, plastic, or composite.

As noted herein, the treatment fluid pumped through the sleeve 100 can be a high-pressure fracture fluid pumped during a fracturing operation to form fractures in the formation. The fracturing fluid typically contains a chemical and/or proppant to treat the surrounding formation. In addition, granular materials in slurry form can be pumped into a well-bore to improve production as part of a gravel pack operation. The slurries in any of these various operations can be viscous and can flow at a very high rates (e.g., above 10 bbls/min) so that the slurry's flow is highly erosive. Exposed to such flow, the buttons 150 eventually erode away and/or break out of the ports 112 so the ports 112 become exposed to the bore 102. At this point, the treatment fluid passing through the bore 102 can communicate through the exposed ports 112 to the surrounding annulus outside the cluster sleeve 100.

The buttons 150 are in the shape of discs and are held in place in the ports 112 by threads or the like. As shown in the end section of FIG. 4C, a number (e.g., six) of the buttons 150 can be disposed symmetrically about the housing 110 in the ports 112. More or less buttons 150 may be used depending on the implementation, and they may be arranged around the sleeve 100 as shown and/or may be disposed along the length of the sleeve 100.

Figure 5A:
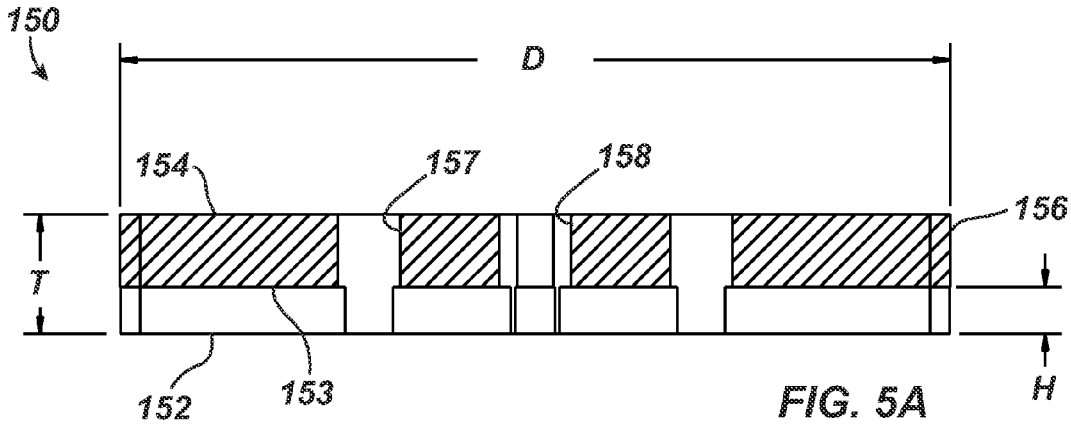
FIGS. 5A-5B illustrate cross-section and plan views of an inset or button for the cluster sliding sleeve of FIGS. 4A-4C.
Figure 5B:
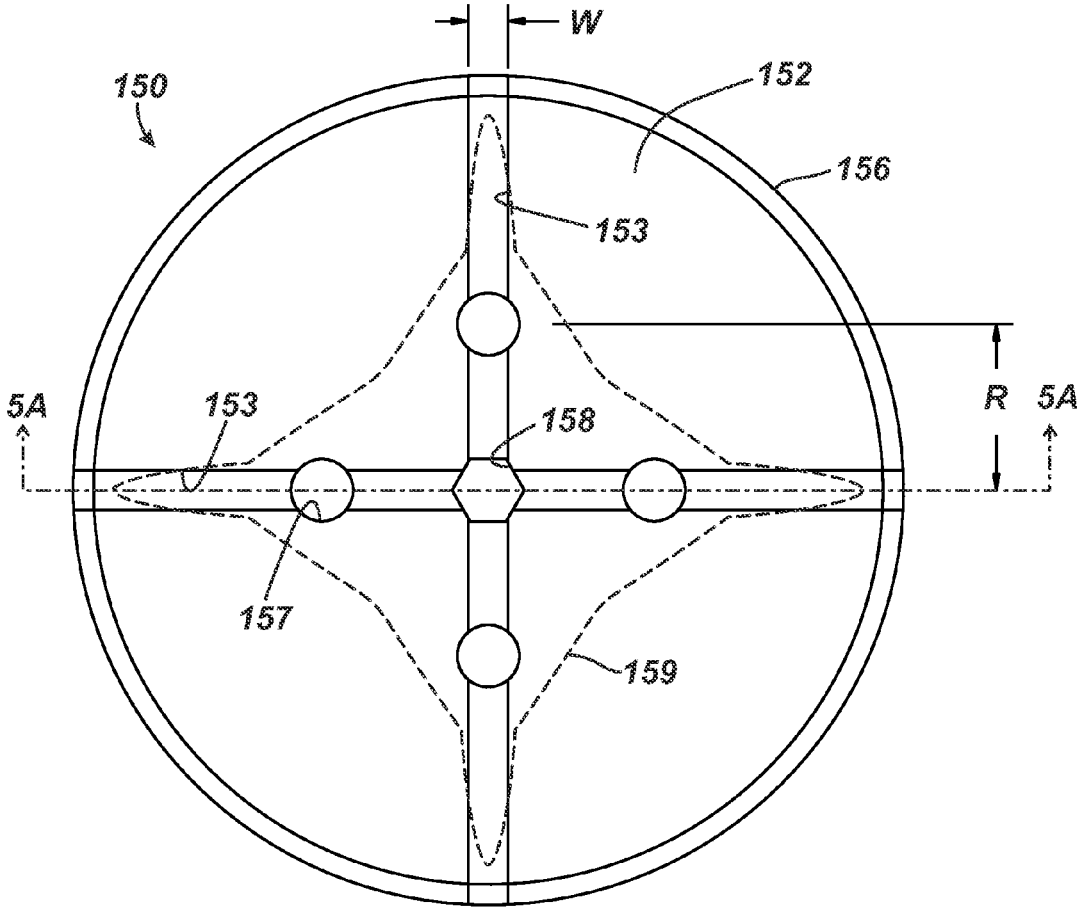

FIGS. 5A-5B show further details of one embodiment of an inset or button 150 according to the present disclosure. As shown, the button 150 has an inner surface 152, an outer surface 154, and a perimeter 156. The inner surface 152 is intended to face inward toward the cluster sleeve's central bore (102), while the outer surface 154 is exposed to the annulus, although the reverse arrangement could be used depending on the intended direction of flow. The perimeter 152 can have thread or the like for holding the button 150 in the sleeve's port (112).

A series of small orifices or holes 157 are defined through the button 150 and allow a limited amount of flow to pass between the tubing and the annulus. As noted previously, the orifices 157 can help the cluster sleeve's insert (120) to open by exposing the insert (120) to a pressure differential. Likewise, the orifices 157 allow treatment fluid to pass through the button 150 and erode it during initial treatment operations as discussed herein.

The orifices 157 are arranged in a peripheral cross-pattern around the button's center, and joined slots 153 in the inner surface 152 pass through the peripheral orifices 157 and the center of the button 150. A hex-shaped orifice 158 can be provided at the center of the button 150 for threading the button 150 in the sleeve's port (112), although a spreader tool may be used on the peripheral orifices 157 or a driver may be used in the slots 153.

Once the insert (120) is moved to the open condition (See FIG. 4B), the initial flow through the button's orifices 157, 158 is small enough to allow the tubing differential to be maintained until the last sleeve of the cluster is opened as disclosed herein. As treatment fluid passes through the small orifices 157/158, however, rapid erosion is encouraged by the pattern of the orifices 157/158 and the slots 153.

As shown, the joined slots 153 can be defined in only one side of the button 150, although other arrangements could have slots on both sides of the button 150. Preferably, the joined slots pass through the orifices 157/158 as shown to enhance erosion. In particular, the outline 159 depicted in FIG. 5B generally indicates the pattern of erosion that can occur in the button 150 when exposed to erosive flow. In general, the central portion of the button 150 erodes due to the several orifices 157/158. Erosion can also creep along the slots 153 where the button 150 is thinner, essentially dividing the button 150 into quarters. As will be appreciated, this pattern of erosion can help remove and dislodge the button 150 from its port (112).

Erosion is preferred to help dislodge the buttons 150 because the erosion occurs as long as there is erosive flow in the sleeve 100. If pressure alone were relied upon to dislodge the buttons 150, sufficient pressure to open all of the ports (112) may be lost should some of the buttons 150 prematurely dislodge from the ports (112) during opening procedures.

Although the buttons 150 are described as eroding to dislodge from the ports (112), it will be appreciated that fluid pressure from the treatment operation may push the buttons 150 from the port (112), especially when the buttons 150 are weakened and/or broken up by erosion. Therefore, as the treatment operation progresses, the buttons 150 can completely erode and/or break away from the ports (112) allowing the full open area of the ports (112) to be utilized.

For the sake of illustration, the diameter D of the button 150 can be about 1.25-in, and the thickness T can be about 0.18-in. The depth H of the slots 153 can be about 0.07-in, while their width W can be about 0.06-in. The orifices 157, 158 can each have a diameter of about 3/32-in, and the peripheral orifices 157 can be offset a distance R of about 0.25-in. from the button's center.

Other configurations, sizes, and materials for the buttons 150 can be used depending on the implementation, the size of the sleeve 100, the type of treatment fluid used, the intended operating pressures, and the like. For example, the number and arrangement of orifices 157, 158 and slots 153 can be varied to produce a desired erosion pattern and length of time to erode. In addition, the particular material of the button 150 may be selected based on the pressures involved and the intended treatment fluid that will produce the erosion.

As noted previously, the dropped ball 130 can pass through the cluster sleeve 100 to open it so the ball 130 can pass further downhole to another cluster sleeve or to an isolation sleeve. In FIG. 6, an isolation sleeve 50 is shown in an opened condition. The isolation sleeve 50 defines a bore 52 therethrough, and an insert 54 can be moved from a closed condition to an open condition (as shown). The dropped ball 130 with its specific diameter is intended to land on an appropriately sized ball seat 56 within the insert 54.

Once seated, the ball 130 typically seals in the seat 56 and does not allow fluid pressure to pass further downhole from the sleeve 50. The fluid pressure communicated down the isolation sleeve 50 therefore forces against the seated ball 130 and moves the insert 54 open. As shown, openings in the insert 54 in the open condition communicate with external ports 56 in the isolation sleeve 50 to allow fluid in the sleeve's bore 52 to pass out to the surrounding annulus. Seals 57, such as chevron seals, on the inside of the bore 52 can be used to seal the external ports 56 and the insert 54. One suitable example for the isolation sleeve 50 is the Single-Shot Zone-Select Sleeve available from Weatherford.

Figure 7A:
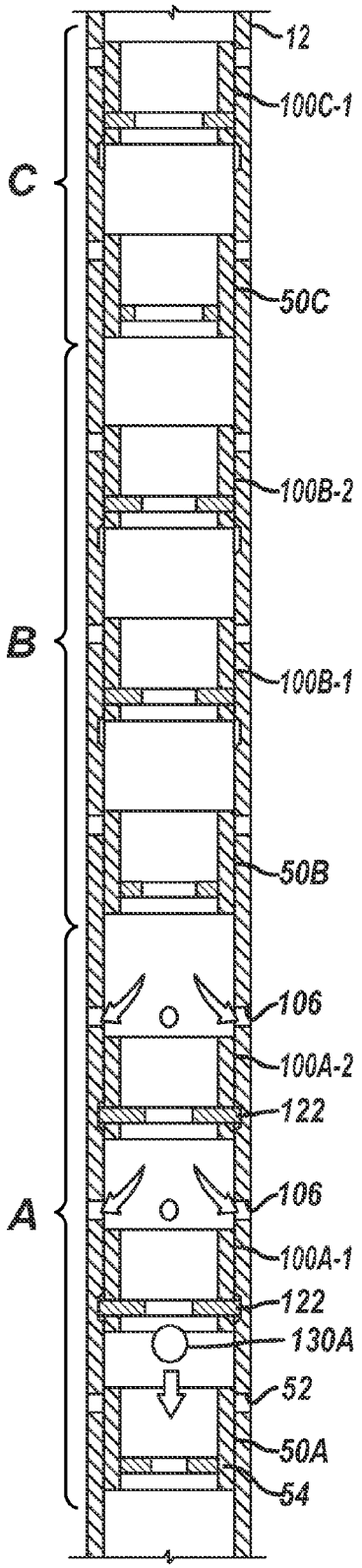
FIGS. 7A-7C schematically illustrate an arrangement of cluster sliding sleeves and isolation sliding sleeves in various stages of operation.
Figure 7B:
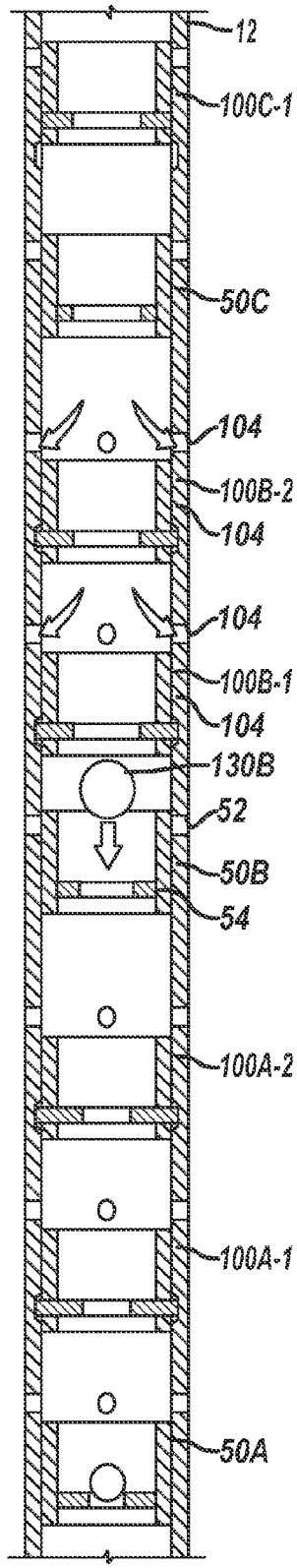
Figure 7C:
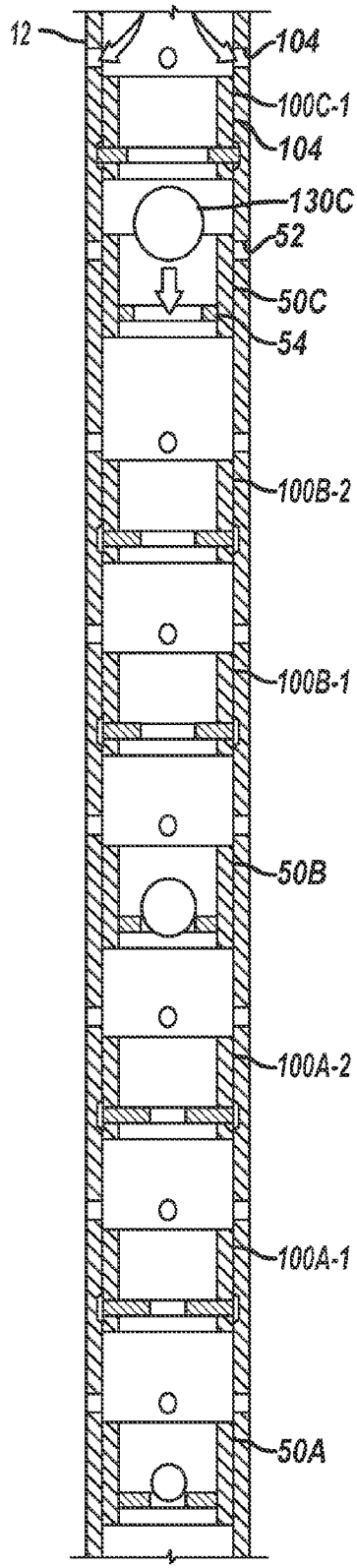

As mentioned previously, several cluster sleeves 100 can be used together on a tubing string and can be used in conjunction with isolation sleeves 50. FIGS. 7A-7C show an exemplary arrangement in which three zones A-C can be separately treated by fluid pumped down a tubing string 12 using multiple cluster sleeves 100, isolation sleeves 50, and different sized balls 130. Although not shown, packers or other devices can be used to isolate the zones A-C from one another. Moreover, packers can be used to independently isolate each of the various sleeves in the same zone from one another, depending on the implementation.

Operation of the cluster sleeves 100 commences according to the arrangement of sleeves 100 and other factors. As shown in FIG. 7A, a first zone A (the lowermost) has an isolation sleeve 50A and two cluster sleeves 100A-1 and 100A-2 in this example. These sleeves 50A, 100A-1, and 100A-2 are designed for use with a first ball 130A having a specific size. Because this first zone A is below sleeves in the other zones B-C, the first ball 130A has the smallest diameter so it can pass through the upper sleeves of these zones B-C without opening them.

As depicted, the dropped ball 130A has passed through the isolation sleeves 50B/50C and cluster sleeves 100B/100C in the upper zones B-C. At the lowermost zone A, however, the dropped ball 130A has opened first and second cluster sleeves 100A-1/100A-2 according to the process described above and has traveled to the isolation sleeve 50A. Fluid pumped down the tubing string can be diverted out the ports 106 in these sleeves 100A-1/100A-2 to the surrounding annulus for this zone A.

In a subsequent stage shown in FIG. 7B, the first ball 130A has seated in the isolation sleeve 50A, opening its ports 56 to the surrounding annulus, and sealing fluid communication past the seated ball 130A to any lower portion of the tubing string 12. As depicted, a second ball 130B having a larger diameter than the first has been dropped. This ball 130B is intended to pass through the sleeves 50C/100C of the uppermost zone C, but is intended to open the sleeves 50B/100B in the intermediate zone B.

As shown, the dropped second ball 130B has passed through the upper zone C without opening the sleeves. Yet, the second ball 130B has opened first and second cluster sleeves 100B-1/100B-2 in the intermediate zone B as it travels to the isolation sleeve 50B. Finally, as shown in FIG. 5C, the second ball 130B has seated in the isolation sleeve 50B, and a third ball 130C of an even greater diameter has been dropped to open the sleeves 50C/100C in the upper most zone C.

The arrangement of sleeves 50/100 depicted in FIGS. 7A-7C is illustrative. Depending on the particular implementation and the treatment desired, any number of cluster sleeves 100 can be arranged in any number of zones. In addition, any number of isolation sleeves 50 can be disposed between cluster sleeves 100 or may not be used in some instances. In any event, by using the cluster sleeves 100, operators can open several sleeves 100 with one-sized ball to initiate a frac treatment in one cluster along an isolated wellbore zone.

The arrangement in FIGS. 7A-7C relied on consecutive activation of the sliding sleeves 50/100 by dropping ever increasing sized balls 130 to actuate ever higher sleeves 50/100. However, depending on the implementation, an upper sleeve can be opened by and pass a smaller sized ball while later passing a larger sized ball for opening a lower sleeve. This can enable operators to treat multiple isolated zones at the same time, with a different number of sleeves open at a given time, and with a non-consecutive arrangement of sleeves open and closed.

Figure 8:
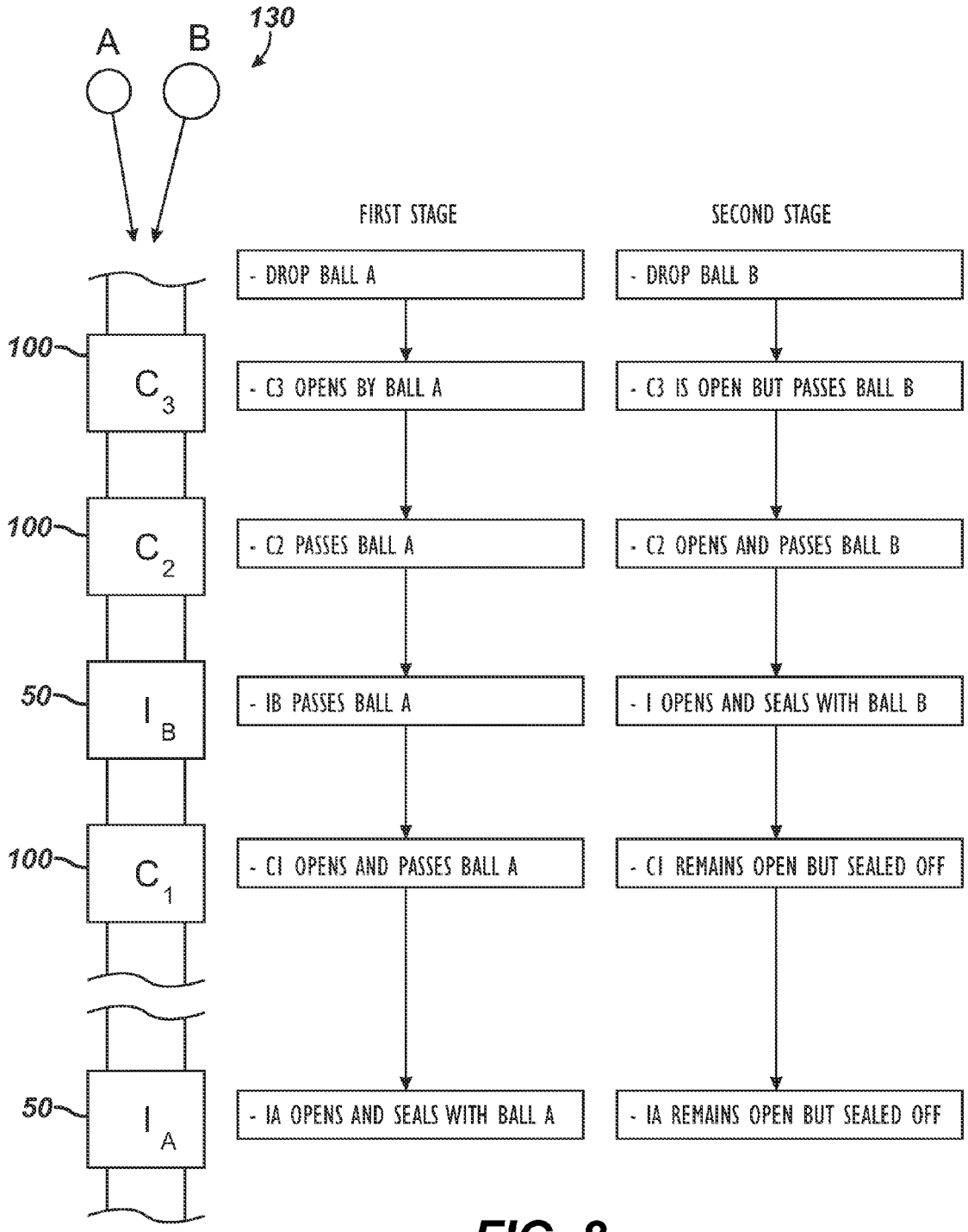
FIG. 8 schematically illustrates another arrangement of cluster sliding sleeves and isolation sliding sleeves in various stages of operation.

For example, FIG. 8 schematically illustrates an arrangement of sliding sleeves 50/100 with a non-consecutive form of activation. The cluster sleeves 100(C1-C3) and two isolation sleeves 50(IA & IB) are shown deployed on a tubing string 12. Dropping of two balls 130(A & B) with different sizes are illustrated in two stages for this example. In the first stage, operators drop the smaller ball 130(A). As it travels, ball 130(A) opens cluster sleeve 100(C3), passes through cluster sleeve 100(C2) without engaging its seat for opening it, passes through isolation sleeve 50(IB) without engaging its seat for opening it, engages the seat in cluster sleeve 100(C1) and opens it, and finally engages the isolation sleeve 50(IA) to open and seal it. Fluid treatment down the tubing string after this first stage will treat portion of the wellbore adjacent the third cluster sleeve 100(C3), the first cluster sleeve 100(C1), and the lower isolation sleeve 50(IA).

In the second stage, operators drop the larger ball 130(B). As it travels, ball 130(B) passes through open cluster sleeve 100(C3). This is possible if the tolerances between the dropped balls 130(A & B) and the seat in the cluster sleeve 100(C3) are suitably configured. In particular, the seat in sleeve 100(C3) can engage the smaller ball 130(A) when the C3's insert has the closed condition. This allows C3's insert to open and let the smaller ball 130(A) pass therethrough. Then, C3's seat can pass the larger ball 130(B) when C3's insert has the opened condition because the seat's key are retracted.

After passing through the third cluster sleeve 100(C3) while it is open, the larger ball 130(B) then opens and passes through cluster sleeve 100(C2), and opens and seals in isolation sleeve 50(IB). Further downhole, the first cluster sleeve 100(C1) and lower isolation sleeve 50(IA) remain open by they are sealed off by the larger ball 130(B) seated in the upper isolation sleeve 50(IB). Fluid treatment at this point can treat the portions of the formation adjacent sleeves 50(IB) and 100(C2 & C3).

As this example briefly shows, operators can arrange various cluster sleeves and isolation sleeves and choose various sized balls to actuate the sliding sleeves in non-consecutive forms of activation. The various arrangements that can be achieved will depend on the sizes of balls selected, the tolerance of seats intended to open with smaller balls yet pass one or more larger balls, the size of the tubing strings, and other like considerations.

For purposes of illustration, a deployment of cluster sleeves 100 can use any number of differently sized plugs, balls, darts or the like. For example, the diameters of balls 130 can range from 1-inch to 3¾-inch with various step differences in diameters between individual balls 130. In general, the keys 142 when extended can be configured to have ⅛-inch interference fit to engage a corresponding ball 130. However, the tolerance in diameters for the keys 142 and balls 130 depends on the number of balls 130 to be used, the overall diameter of the tubing string 12, and the differences in diameter between the balls 130.

Although disclosed for use with a cluster sliding sleeve 100 for a frac operation, the disclosed insets or buttons 150 can be used with any other suitable downhole tool for which temporary obstruction of a port is desired. For example, the disclosed insets or buttons 150 can be used in a port of a conventional sliding sleeve that opens by a plug, manually, or otherwise; a tubing mandrel for a frac operation, a frac-pack operation, a gravel pack operation; a cross-over tool for a gravel pack or frac operation or any other tool in which erosive flow or treatment is intended to pass out of or into the tool through a port.

Figure 9:
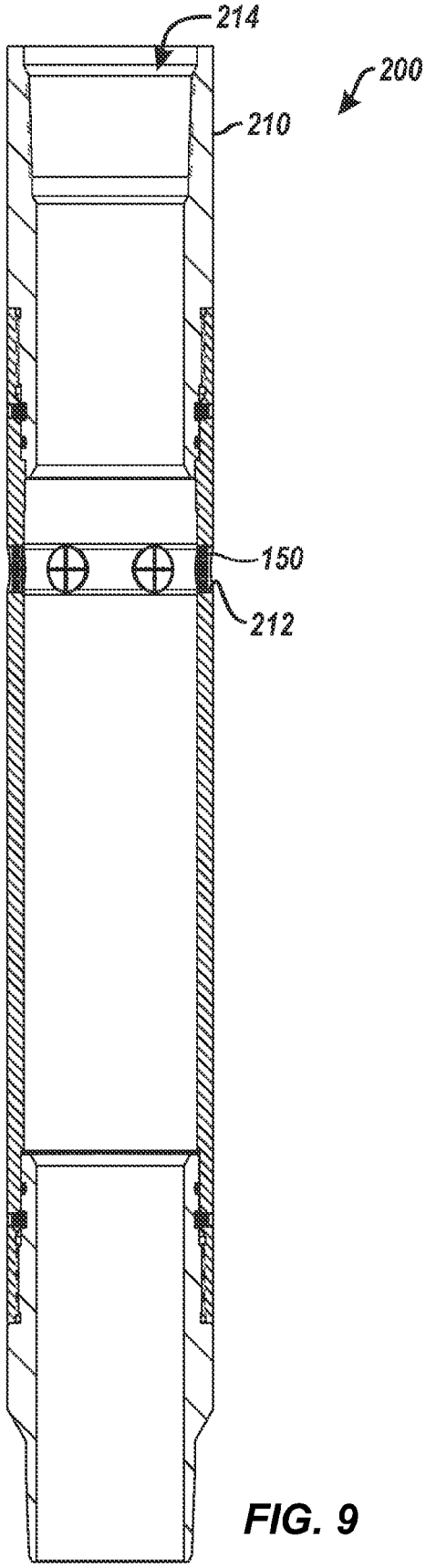
FIG. 9 illustrates a cross-section of a downhole tool having insets according to the present disclosure disposed in ports thereof.

As one example, the disclosed insets or buttons 150 can be used in a port of a downhole tool 200 as shown in FIG. 9. Here, the tool 200 can be a tubing mandrel that can dispose on a length of tubing string (not shown) for a frac operation or the like. The tool 200 has a housing 210 defining a bore 214 and defining at least one port 212 communicating the bore 214 outside the housing 210. At least one inset or button 150 is disposed in the at least one port 212 to restrict fluid flow therethrough at least temporarily.

In the current arrangement, the button 150 is similar to that shown in FIGS. 5A-5B, although the button 150 can have any of the other arrangements disclosed herein. At some point during operations (e.g., when treatment fluid is applied through the tubing), the button 150 dislodges from the port 212 by application of fluid pressure, by breaking up, by erosion, or by a combination of these as disclosed herein. Delaying the release of the fluid to the annulus may have particular advantages depending on the implementation. The buttons 150 may also be arranged to erode in an opposite flow orientation, such as when flow from the annulus is intended to pass into the downhole tool 200 through the ports 212 after being temporarily restricted by the buttons 150.

The foregoing description of preferred and other embodiments is not intended to limit or restrict the scope or applicability of the inventive concepts conceived of by the Applicants. In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A downhole sliding sleeve disposed on a tubing string with at least one other sliding sleeve in a wellbore and actuated by application of fluid pressure against a plug deployed in the sliding sleeve, the sliding sleeve comprising:

a housing defining a bore and defining at least one port communicating the bore outside the housing;

an insert disposed in the bore and being movable from a closed condition to an opened condition relative to the at least one port;

a seat disposed on the insert, the seat engaging the plug when the insert has the closed condition, the seat moving the insert from the closed condition to the opened condition with the application of the fluid pressure against the engaged plug, the seat releasing the plug when the insert has the opened condition; and at least one inset member disposed in the at least one port, the at least one inset member at least temporarily maintaining the fluid pressure in the tubing string after the insert has moved to the opened condition at least until the at least one other sliding sleeve on the tubing string is opened with the maintained fluid pressure.

2. The sliding sleeve of claim 1, wherein the insert defines slots, and wherein the seat comprises a plurality of keys movable between extended and retracted positions in the slots.

3. The sliding sleeve of claim 1, further comprising seals disposed between the bore and the insert and sealing off the at least one port when the insert is in the closed condition.

4. The sliding sleeve of claim 1, further comprising a catch temporarily holding the insert in the closed condition.

5. The sliding sleeve of claim 1, further comprising a lock locking the insert in the opened condition.

6. The sliding sleeve of claim 1, wherein the at least one inset member defines at least one orifice therethrough.

7. The sliding sleeve of claim 6, wherein the at least one orifice produces a pressure differential across the insert in the closed condition and facilitates the movement of the insert to the opened condition.

8. The sliding sleeve of claim 6, wherein the at least one inset member defines at least one slot on at least one side thereof.

9. The sliding sleeve of claim 8, wherein the at least one slot intersects the at least one orifice in the at least one side.

10. The sliding sleeve of claim 8, wherein the at least one slot comprises a plurality of slots intersecting at a center in the at least one inset member.

11. The sliding sleeve of claim 10, wherein the at least one orifice is defined at the center in the at least one inset member, and wherein the at least one inset member comprises a plurality of additional orifices therethrough, each of the additional orifices intersected by one of the slots.

12. The sliding sleeve of claim 1, wherein the at least one inset member dislodges from the at least one port with the application of an increased fluid pressure, breaks up in the at least one port, erodes from the at least one port, or performs a combination thereof to subsequently permit fluid communication through the at least one port.

13. The sliding sleeve of claim 12, wherein the at least one inset member dislodges from the at least one port when subjected to the increased fluid pressure of a frac operation.

14. A downhole well fluid system, comprising:

a plurality of sliding sleeves disposed on a tubing string in a wellbore, each of the sliding sleeves being closed relative to at least one port in each sliding sleeve, each of the sliding sleeves opening with fluid pressure applied against a first plug deployed in each sliding sleeve;

wherein a first of the sliding sleeves comprises an inset member being temporarily disposed in the at least one port, the inset member at least temporarily maintaining the fluid pressure in the tubing string and allowing the maintained fluid pressure to act against the first plug at least until a second of the sliding sleeves on the tubing string is opened with the maintained fluid pressure.

15. The system of claim 14, wherein the first sliding sleeve comprises:

an insert disposed in the first sliding sleeve and being movable from a closed condition to an opened condition relative to the at least one port; and a seat disposed on the insert, the seat engaging the first plug when the insert has the closed condition, the seat moving the insert from the closed condition to the opened condition with the application of the fluid pressure against the first plug, the seat releasing the first plug when the insert has the opened condition.

16. The system of claim 15, wherein the at least one inset member defines at least one orifice producing a pressure differential across the insert in the closed condition and facilitating the movement of the insert to the opened condition.

17. The system of claim 14, wherein the second sliding sleeve comprises second components similar to first components of the first sliding sleeve.

18. The system of claim 14, wherein the second sliding sleeve comprises an isolation sleeve engaging the first plug and preventing fluid communication in the tubing string therepast.

19. The system of claim 14, further comprising a third of the sliding sleeves disposed on the tubing string either uphole or downhole of the first sliding sleeve, the third sliding sleeve being closed relative to the at least one port in the third sliding sleeve, the third sliding sleeve opening with the fluid pressure applied against a second plug deployed in the third sliding sleeve.

20. The system of claim 19, wherein the third sliding sleeve passes the first plug therethrough without being opened, passes the second plug down the tubing string after opening, or engages the second plug after opening and prevents fluid communication in the tubing string therepast.

21. The system of claim 14, wherein the at least one inset member defines at least one orifice therethrough, the at least one orifice producing a pressure differential across the first sliding sleeve in the closed condition and facilitating opening of the first sliding sleeve.

22. The system of claim 21, wherein the at least one inset member defines at least one slot on at least one side thereof.

23. The system of claim 22, wherein the at least one slot intersects the at least one orifice in the at least one inset member.

24. The system of claim 22, wherein the at least one slot comprises a plurality of slots intersecting at a center in the at least one inset member.

25. The system of claim 24, wherein the at least one orifice is defined at the center in the at least one inset member, and wherein the at least one inset member comprises a plurality of additional orifices therethrough, each of the additional orifices intersected by one of the slots.

26. The system of claim 14, wherein the at least one inset member dislodges from the at least one port with the application of an increased fluid pressure, breaks up in the at least one port, erodes from the at least one port, or performs a combination thereof to subsequently permit fluid communication through the at least one port.

27. A wellbore fluid treatment method, comprising:

deploying at least two sliding sleeves on a tubing string in a wellbore;

engaging a first plug in a first of the at least two sliding sleeves, the first sliding sleeve being closed relative to at least one first port in the first sliding sleeve;

opening the closed first sliding sleeve relative to the at least one first port by applying fluid pressure against the engaged first plug;

passing the first plug through the open first sliding sleeve to a second of the at least two sliding sleeves on the tubing string; and maintaining the fluid pressure in the tubing string at least until the second sliding sleeve is opened by at least temporarily preventing loss of the fluid pressure in the tubing string out the at least one first port after opening the first sliding sleeve and passing the first plug therethrough.

28. The method of claim 27, further comprising facilitating opening of the closed first sliding sleeve by permitting wellbore pressure through the at least one first port in the closed first sliding sleeve.

29. The method of claim 28, wherein facilitating opening of the closed first sliding sleeve comprises producing a pressure differential across an insert in a closed condition in the closed first sliding sleeve with the wellbore pressure permitted through an orifice in a temporary restriction of the at least one first port.

30. The method of claim 27, further comprising:

engaging the first plug in the second sliding sleeve, the second sliding sleeve being closed relative to at least one second port in the second sliding sleeve; and opening the second sliding sleeve relative to the at least one second port by applying the fluid pressure against the engaged first plug.

31. The method of claim 30, further comprising passing the first plug through the open second sliding sleeve.

32. The method of claim 30, further comprising seating the first plug in the open second sliding sleeve and preventing fluid communication in the tubing string therepast.

33. The method of claim 27, further comprising permitting fluid communication through the at least one first port in the open first sliding sleeve by dislodging a temporary restriction of the at least one first port with application of an increased fluid pressure against the temporary restriction, by breaking up the temporary restriction, by eroding the temporary restriction, or by a combination thereof.

34. The method of claim 33, wherein dislodging the temporary restriction of the at least one first port with the application of the increased fluid pressure against the temporary restriction comprises applying the increased fluid pressure for a frac operation.

35. The method of claim 27, wherein the at least two sliding sleeves deployed on the tubing string comprise a third sliding sleeve disposed uphole on the tubing string from the first sliding sleeve, the third sliding sleeve being closed relative to at least one third port in the first sliding sleeve.

36. The method of claim 35, further comprising passing the first plug through the closed third sliding sleeve to the first sliding sleeve without opening the closed third sliding sleeve.

37. The method of claim 35, further comprising:

opening the third sliding sleeve with the first plug;

passing the first plug through the open third sliding sleeve to the closed first sliding sleeve; and permitting opening of the closed first sliding sleeve with the first plug by at least temporarily preventing loss of the fluid pressure in the tubing string out the at least one third port after opening the third sliding sleeve.

38. The method of claim 35, further comprising:

engaging a second plug in the closed third sliding sleeve; and opening the closed third sliding sleeve relative to the at least one third port by applying the fluid pressure against the engaged second plug.

39. The method of claim 38, wherein the second plug has a larger size than the first plug.

40. The method of claim 38, further comprising:

passing the second plug through the open third sliding sleeve; and permitting opening of the closed second sliding sleeve with the second plug by at least temporarily preventing loss of the fluid pressure in the tubing string out the at least one third port after opening the third sliding sleeve.

* * * * *